US006321690B1

(12) United States Patent
Zilka et al.

(10) Patent No.: US 6,321,690 B1
(45) **Date of Patent: *Nov. 27, 2001**

(54) DEVICE, SYSTEM AND METHOD FOR ON-LINE EXPLOSIVE DESLAGGING

(75) Inventors: Francis Zilka; Timothy Zilka, both of Saratoga, NY (US); Kurt Prouty, Norwell, MA (US); Donald Howard, Ballston Spa, NY (US); Christopher Scaringe, Cohoes, NY (US); William Youngs, Delmar, NY (US)

(73) Assignee: North American Industrial Services, Inc., Ballston Spa, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/394,377

(22) Filed: Sep. 10, 1999

Related U.S. Application Data

(63) Continuation-in-part of application No. 09/341,395, filed as application No. PCT/US98/00718 on Jan. 14, 1998, which is a continuation of application No. 08/786,096, filed on Jan. 17, 1997, now Pat. No. 5,769,034.

(51) Int. Cl.[7] ..... F22B 37/18

(52) U.S. Cl. ..... 122/379; 165/84; 165/95

(58) Field of Search ..... 122/379; 165/84, 165/95

(56) References Cited

U.S. PATENT DOCUMENTS

| | | |
|---|---|---|
| 2,840,365 | 6/1958 | Kruk . |
| 3,053,525 | 9/1962 | Leroy . |

(List continued on next page.)

FOREIGN PATENT DOCUMENTS

| | | |
|---|---|---|
| 20822/70 | 4/1972 | (AU) . |
| 538867 | 1/1955 | (BE) . |
| 2567426 | 1/1986 | (FR) . |
| 823353 | 11/1959 | (GB) . |
| 41977 | 8/1962 | (LU) . |

OTHER PUBLICATIONS

Database WPI, Section Ch, Week 9504, Derwent Publications Ltd., London, GB; Class J09, AN 95–027953, XP002061357 & JP 06 313 532 (Shingawaw Fire Brick), Nov. 8, 1994.

Database WPI, Section Ch, Week, 9426, Derwent Publications Ltd., London, GB; Class M24, AN 94–211580, XP002061357 & JP 06 147 775 (NIppon Steel Corp.). May 27, 1994.

*Primary Examiner*—Denise L. Ferensic
*Assistant Examiner*—Jiping Lu
(74) *Attorney, Agent, or Firm*—Jay R. Yablon

(57) ABSTRACT

A device, system and method permitting on-line explosives-based cleaning and deslagging of a fuel burning facility such as a boiler, furnace, incinerator, or scrubber. A coolant, such as ordinary water, is delivered to the explosives to prevent them from detonating due to the heat of the on-line facility. Thus, controlled, appropriately-timed detonation can be initiated as desired, and boiler scale and slag is removed without the need to shut down or cool down the facility. Alternative preferred embodiments include, but are not limited to: (1) using a non-liquid coolant, such as compressed air or other non-flammable gas, in place of the aforementioned liquid coolant; (2) using one or more highly-heat-resistant insulating materials to insulate the explosive and detonator cap, in place of or in addition to the aforementioned liquid or gaseous coolants; and (3) preparing and using a highly-heat-resistant explosive device, in place of or in addition to the aforementioned liquid or gaseous coolants, and/or the aforementioned highly-heat-resistant insulating materials, in any desired combination.

70 Claims, 6 Drawing Sheets

U.S. PATENT DOCUMENTS

| | | | |
|---|---|---|---|
| 3,552,259 | | 1/1971 | Griffin . |
| 4,166,418 | | 9/1979 | Calder, Jr. . |
| 4,167,139 | | 9/1979 | Gleason et al. . |
| 4,354,294 | | 10/1982 | Silver . |
| 4,462,319 | | 7/1984 | Larsen . |
| 4,545,411 | | 10/1985 | Wierzba . |
| 4,639,381 | | 1/1987 | Wierzba . |
| 5,056,587 | | 10/1991 | Jones . |
| 5,113,802 | | 5/1992 | LeBlanc . |
| 5,193,491 | | 3/1993 | Oslin . |
| 5,196,648 | | 3/1993 | Jones . |
| 5,211,135 | | 5/1993 | Correia . |
| 5,279,676 | | 1/1994 | Oslin . |
| 5,307,743 | | 5/1994 | Jones . |
| 5,494,004 | | 2/1996 | Hunter . |
| 5,517,950 | | 5/1996 | Kendrick . |
| 5,769,034 | * | 6/1998 | Zilka et al. ..... 122/379 |

* cited by examiner

DEVICE, SYSTEM AND METHOD FOR ON-LINE EXPLOSIVE DESLAGGING

CROSS-REFERENCE TO RELATED APPLICATIONS

This application is a continuation-in-part of application Ser. No. 09/341,395 filed Jul. 8, 1999, which is a U.S. 371 national stage application of international application PCT/US98/00718 filed Jan. 14, 1998, which in turn is a continuation of application Ser. No. 08/786,096, filed Jan. 17, 1997, now U.S. Pat. No. 5,769,034, issued Jun. 23, 1998.

FIELD OF THE INVENTION

This disclosure relates generally to the field of boiler/furnace deslagging, and particularly, discloses a device, system and method allowing on-line, explosives-based deslagging.

BACKGROUND OF THE INVENTION

A variety of devices and methods are used to clean slag and similar deposits from boilers, furnaces, and similar heat exchange devices. Some of these rely on chemicals or fluids that interact with and erode deposits. Water cannons, steam cleaners, pressurized air, and similar approaches are also used. Some approaches also make use of temperature variations. And, of course, various types of explosive, creating strong shock waves to blast slag deposits off of the boiler, are also very commonly used for deslagging.

The use of explosive devices for deslagging is a particularly effective method, as the large shock wave from an explosion, appropriately positioned and timed, can easily and quickly separate large quantities of slag from the boiler surfaces. But the process is costly, since the boiler must be shut down (i.e. brought off line) in order to perform this type of cleaning, and valuable production time is thereby lost. This lost time is not only the time during which the cleaning process is being performed. Also lost are several hours prior to cleaning when the boiler must be taken off line to cool down, and several hours subsequent to cleaning for the boiler to be restarted and brought into full operational capacity.

Were the boiler to remain on-line during cleaning, the immense heat of the boiler would prematurely detonate any explosive placed into the boiler, before the explosive has been properly positioned for detonation, rendering the process ineffective and possibly damaging the boiler. Worse, loss of control over the precise timing of detonation would create a serious danger for personnel located near the boiler at the time of detonation. So, to date, it has been necessary to shut down any heat exchange device for which explosives-based deslagging is desired.

Several U.S. patents have been issued on various uses of explosives for deslagging. U.S. Pat. Nos. 5,307,743 and 5,196,648 disclose, respectively, an apparatus and method for deslagging wherein the explosive is placed into a series of hollow, flexible tubes, and detonated in a timed sequence. The geometric configuration of the explosive placement, and the timing, are chosen to optimize the deslagging process.

U.S. Pat. No. 5,211,135 discloses a plurality of loop clusters of detonating cord placed about boiler tubing panels. These are again geometrically positioned, and detonated with certain timed delays, to optimize effectiveness.

U.S. Pat. No. 5,056,587 similarly discloses placement of explosive cord about the tubing panels at preselected, appropriately spaced locations, and detonation at preselected intervals, once again, to optimize the vibratory pattern of the tubing for slag separation.

Each of these patents discloses certain geometric configurations for placement of the explosive, as well as timed, sequential detonation, so as to enhance the deslagging process. But in all of these disclosures, the essential problem remains. If the boiler were to remain on-line during deslagging, the heat of the boiler would cause the explosive to prematurely detonate before it is properly placed, and this uncontrolled explosion will not be effective, may damage the boiler, and could cause serious injury to personnel.

U.S. Pat. No. 2,840,365 appears to disclose a method for introducing a tube into "a hot space such as an oven or a slag pocket for an oven" prior to the formation of deposits in the hot space; continuously feeding a coolant through the tube during the formation of deposits in the hot space, and, when it is time to break the deposits, inserting an explosive into the tube after the formation of the deposits while the tube is still somewhat cooled, and detonating the explosive before it has a chance to heat up and undesirably self-detonate. (See, e.g., col. 1, lines 44–51, and claim 1) There are a number of problems with the invention disclosed by this patent.

First, the hot space according to this patent must be thoroughly prepared and preconfigured, in advance, for the application of this method, and the tubes that contain the coolant and later the explosive, as well as the coolant feeding and discharge system, must be in place on a more or less permanent basis. The tubes are "inserted before the deposits begin to form or before they are formed sufficiently to cover the points where one wishes to insert the tubes" and are "cooled by the passage of a cooling fluid . . . therethrough during operation." (col. 2, lines 26–29 and col. 1, lines 44–51) It is necessary "to provide sealable holes in several bricks for allowing the tube . . . to be inserted, or . . . to remove the bricks during operation of the furnace so that a hole is formed through which the tube may be inserted." (col. 2, lines 32–36) The tubes are supported "at the back end of the pocket upon supports made for the purpose, e.g., by a stepped shape of the back of the wall . . . [or] at the front end or in front of and in the wall . . . [or by having] at least the higher tubes . . . rest immediately upon the deposits already formed." (col. 2, lines 49–55) A complicated series of hoses and ducts are attached for "feeding cooling water . . . and discharging said cooling water." (col. 3, lines 1–10, and FIG. 2 generally) And, the tubes must be cooled whenever the hot space is in operation to prevent the tubes from burning and the water from boiling. (see, e.g., col. 3 lines 14–16 and col. 1, lines 44–51) In sum, this invention cannot simply be brought onto the site of a hot space after deposits have formed and then used at will to detonate the deposits while the hot space is still hot. Rather, the tubes must be in place and continuously cooled essentially throughout the entire operation of the hot space and the accumulation of deposits. And, significant accommodations and preparation such as tube openings and supports, the tubes themselves, and coolant supply and drainage infrastructure, must be permanently established for the associated hot space.

Second, the method disclosed by this patent is dangerous, and must be performed quickly to avoid danger. When the time arrives to break the slag deposits, "the pipes . . . are drained," various cocks, hoses, bolts and an inner pipe are loosened and removed, and "explosive charges are now inserted [into the pipe] . . . immediately after termination of the cooling so that no danger of self-detonation exists, because the explosive charges cannot become too hot before being exploded intentionally." (col. 3, lines 17–28) Then, the "tubes are exploded immediately after stopping the cooling at the end of the operation of the furnace . . . " (col. 1, lines 49–51) Not only is the process of draining the pipe and readying it to receive the explosive fairly cumbersome, it must also be done in a hurry to avoid the danger of premature explosion. As soon as the coolant flow is ceased, time is of the essence, since the tubes will begin to heat up, and the explosives must be placed into the tubes and purposefully detonated quickly, before the heating of the tube become so great that the explosive accidentally self-detonates. There is nothing in this patent that discloses or suggests how to ensure that the explosive will not self-detonate, so that the process does not have to be unnecessarily hurried to avoid premature detonation.

Third, the pre-placement of the tubes as discussed above constrains the placement of the explosive when the time for detonation arrives. The explosives must be placed into the tubes in their preexisting location. There is no way to simply approach the hot space after the slag accumulation, freely choose any desired location within the hot space for detonation, move an explosive to that location in an unhurried manner, and then freely and safely detonate the explosive at will.

Fourth, it may be inferred from the description that there is at least some period of time during which the hot space must be taken out of operation. Certainly, operation must cease long enough for the site to be prepared and fitted to properly utilize the invention as described earlier. Since one object of the invention is to "prevent the oven . . . to be taken out of operation for too long a time," (col. 1, lines 39–41, emphasis added), and, since the "tubes are exploded immediately after stopping the cooling at the end of the operation of the furnace or the like" (col. 1, lines 49–51, emphasis added), it appears from this description that the hot space is in fact shut down for at least some time prior to detonation, and that the crux of the invention is to hasten the cooling of the slag body after shutdown so that detonation can proceed more quickly without waiting for the slag body to cool down naturally (see col. 1, lines 33–36), rather than to allow detonation to occur while the hot space is in full operation without any shutdown at all.

Finally, because of all the site preparation that is needed prior to using this invention, and due to the configuration shown and described for placing the tubes, this invention does not appear to be usable across the board with any form of hot space device, but only with a limited type of hot space device that can be readily preconfigured to support the disclosed horizontal tubing structure as disclosed.

Luxemburg patent no. 41,977 has similar problems to U.S. Pat. No. 2,840,365, particularly: insofar as this patent also requires a significant amount of site preparation and preconfiguration before the invention disclosed thereby can be used; insofar as one cannot simply approach the hot space after the slag accumulation, freely choose any desired location within the hot space for detonation, move an explosive to that location in an unhurried manner, and then freely and safely detonate the explosive at will; and insofar as the types of hot space devices to which this patent applies also appear to be limited.

According to the invention disclosed by this patent, a "blasting hole" must be created within the subject hot space before the invention can be used. (translation of page 2, second full paragraph) Such holes are "drilled at the time of need or made prior to the formation of the solid mass." (translation of paragraph beginning on page 1 and ending on page 2) Since the device for implementing the process of the invention "includes at least a tube that permits feeding the cooling fluid into the bottom of the blasting hole" (translation of page 2, fourth full paragraph) and, in one form of implementation, "a retaining plate . . . positioned at the bottom of the blast hole (translation of paragraph beginning on page 2 and ending on page 3), and since it is a key feature of the invention that the blast hole is filled with coolant prior to and during the insertion of the explosive, it may be inferred from this description that the blast hole is substantially vertical in it orientation, or at least has a significant enough vertical component to enable water to effectively accumulate and pool within the blast hole.

Because the subject hot space must be preconfigured with a blast hole or holes (with implicitly at least a substantial vertical component) before this invention can be used, it is again not possible to simply approach an unprepared hot space at will after deposits have accumulated, and detonate at will. Since the coolant and the explosive must be contained within the blast holes, it is not possible to freely move and position the explosive wherever desired within the hot space. The explosives can only be positioned and detonated within the blast holes pre-drilled for that purpose. Due to the at least partially vertical orientation of the blast holes, the angle of approach for introducing the coolant and the explosive is necessarily constrained. Also, while it is not clear from the disclosure how the blast holes are initially drilled, it appears that at least some amount of boiler shutdown and/or disruption would be required to introduce these blast holes.

Finally, in both of these cited patents, the components which hold the coolant (the tubes for U.S. Pat. No. 2,840,365 and the blast holes for LU 41,977) reside within the hot space, and are already very hot when the time arrives to deslag. The object of both of these patents, is to cool these components down before the explosive is introduced. U.S. Pat. No. 2,840,365 achieves this by virtue of the fact that the tubes are continuously cooled throughout the operation of the hot space, which, again, is very disruptive and requires significant preparation of and modification to the hot space. And LU 41,977 clearly states that "[a]ccording to all its forms of implementation, the device is put in place without a charge for the purpose of cooling the blast hole for a few hours with the injection fluid (translation of page 4, last full paragraph, emphasis added). It would be desirable to avoid this cooldown period altogether and therefore save time in the deslagging process, and to simply introduce a cooled explosive into a hot space at will without any need to alter or preconfigure the boiler, and to then detonate the cooled explosive at will once it has been properly placed in whatever detonation location is desired. And most certainly, the application of LU 41,977 is limited only to hot spaces into which it is feasible to introduce a blast hole, which appears to eliminate many types of heat-exchange device into which it is not feasible to introduce a blast hole.

OBJECTS OF THE INVENTION

It would be desirable if a device, system and method could be devised which would allow explosives to safely and controllably be used for deslagging, on-line, without any need to shut down the boiler during the deslagging process. By enabling a boiler or similar heat-exchange device to remain on-line for explosives-based deslagging, valuable operations time for fuel-burning facilities could then be recovered.

It is therefore desired to provide a device, system and method whereby explosives may be used to clean a boiler, furnace, scrubber, or any other heat exchange device, fuel burning, or incinerating device, without requiring that device to be shut down, thereby enabling that device to remain in full operation during deslagging.

It is desired to enable valuable operations time to be recovered, by virtue of eliminating the need for shutdown of the device or facility to be cleaned.

It is desired to enhance personnel safety and facility integrity, by enabling this on-line explosives-based cleaning to occur in a safe and controlled manner.

SUMMARY OF THE INVENTION

A preferred embodiment of the invention enables explosives to be used for cleaning slag from a hot, on-line boiler, furnace, or similar fuel-burning or incineration device, by delivering a coolant to the explosive which maintains the temperature of the explosive well below what is required for detonation. The explosive, while it is being cooled, is delivered to its desired position inside the hot boiler without detonation. It is then detonated in a controlled manner, at the time desired.

While many obvious variations may occur to someone of ordinary skill in the relevant arts, the preferred embodiment disclosed herein uses a perforated or semi-permeable membrane which envelopes the explosive and the detonator cap or similar device used to detonate the explosive. A liquid coolant, such as ordinary water, is delivered at a fairly constant flow rate into the interior of the envelope, thereby cooling the external surface of the explosive and maintaining the explosive well below detonation temperature. Coolant within the membrane in turn flows out of the membrane at a fairly constant rate, through perforations or microscopic apertures in the membrane. Thus cooler coolant constantly flows into the membrane while hotter coolant that has been heated by the boiler flows out of the membrane, and the explosive is maintained at a temperature well below that needed for detonation. Coolant flow rates typical of the preferred embodiment run between 20 and 80 gallons per minute.

This coolant flow is initiated as the explosive is first being placed into the hot boiler. Once the explosive has been moved into the proper position and its temperature maintained at a low level, the explosive is detonated as desired, thereby separating the slag from, and thus cleaning, the boiler.

Alternative preferred embodiments include, but are not limited to: (1) using a non-liquid coolant, such as compressed air or other non-flammable gas, in place of the aforementioned liquid coolant; (2) using one or more highly-heat-resistant insulating materials to insulate the explosive and detonator cap, in place of or in addition to the aforementioned liquid or gaseous coolants; and (3) preparing and using a highly-heat-resistant explosive device, in place of or in addition to the aforementioned liquid or gaseous coolants, and/or the aforementioned highly-heat-resistant insulating materials, in any desired combination.

BRIEF DESCRIPTION OF THE DRAWING

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION OF THE INVENTION

Figure 1:
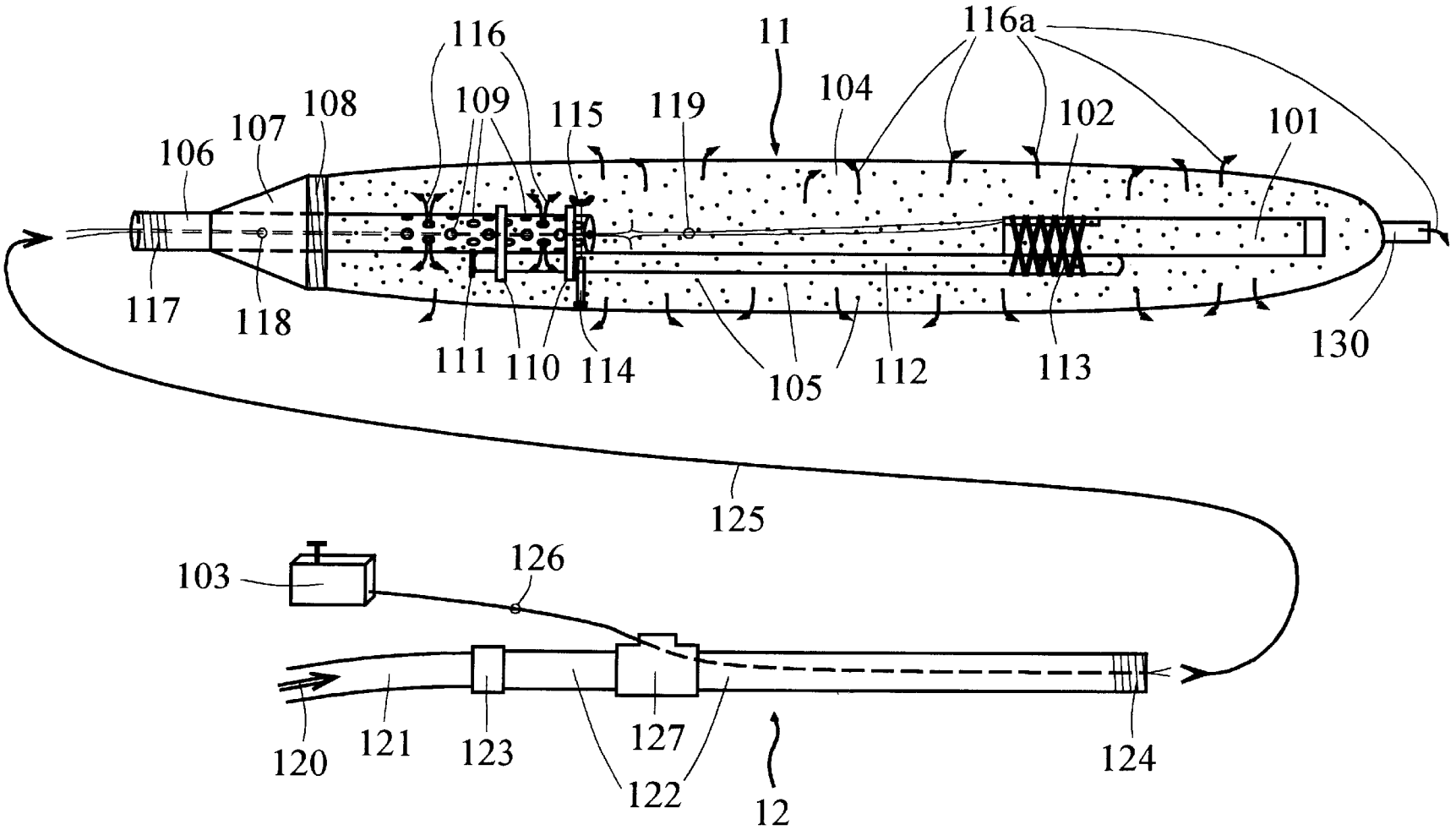
FIG. 1 illustrates in plan view, a preferred embodiment of a device, system and method used to perform on-line explosive cleaning of a fuel-burning facility, using a liquid or gaseous coolant.

FIG. 1 depicts a preferred embodiment of a basic tool used for on-line cleaning of a fuel-burning facility such as a boiler, furnace, or similar heat exchange device, or an incineration device, and the discussion following outlines the associated method for such on-line cleaning.

The cleaning of the fuel burning and/or incineration facility is carried out in the usual manner by means of an explosive device 101, such as but not limited to an explosive stick or other explosive device or configuration, placed appropriately inside the facility, and then detonated such that the shock waves from the explosion cause slag and similar deposits to dislodge from the walls, tubing, etc. of the facility. This explosive device 101 is detonated by a standard explosive detonator cap 102 or similar detonating device, which causes controlled detonation at the desired instant, based on a signal sent from a standard initiator 103, by a qualified operator.

However, to enable explosives-based cleaning to be performed on-line, i.e., without any need to power down or cool down the facility, two prior art problems must be overcome. First, since explosives are heat-sensitive, the placement of an explosive into a hot furnace can cause premature, uncontrolled detonation, creating danger to both the facility and personnel around the explosion. Hence, it is necessary to find a way of cooling the explosive device 101 while it is being placed in the on-line facility and readied for detonation. Second, it is not possible for a person to physically enter the furnace or boiler to place the explosive, due the immense heat of the on-line facility. Hence, it is necessary to devise a means of placing the explosive that can be managed and controlled from outside the burner or furnace.

In order to properly cool explosive device 101, a cooling envelope 104 is provided which completely envelopes explosive device 101. During operation, in a preferred embodiment, cooling envelope 104 has pumped into it a coolant, such as ordinary water, that maintains explosive device 101 in a cooled-down state until it is ready for detonation. Because of the direct contact between the coolant and explosive device 101, explosive device 101 is ideally made of a plastic or similar waterproof housing that contains the actual explosive powder or other explosive material.

In an alternative preferred embodiment, air and/or gases are used instead of a liquid coolant. Here, it is preferred to circulate normal room temperature air through the device. This can be accomplished by using a standard commercial air compressor (not shown) to deliver and move the air past explosive device 101. Alternatively, cooled or refrigerated air from a portable air conditioning unit is circulated past explosive device 101, either providing pressurization from the air conditioning unit, or using pressure provided by an air compressor. Also contemplated is the circulation of one or more non-flammable gasses such as nitrogen, or any other inert gas such as, but not limited to, carbon dioxide, halocarbon, helium, and others, past explosive device 101, similar to the circulation of normal air. It is to be understood that the terms "gas" or "gaseous" within this disclosure are intended to encompass air and any other composite gasses which, from a chemical standpoint, comprise a mixture of two or chemically-distinct gases.

It is important for cooling envelope 104 to provide a continuous flow of coolant, whether fluid or gaseous, past explosive device 101. To achieve this, cooling envelope 104 in the preferred embodiment is a semi-permeable membrane that allows liquid or gaseous coolant to flow out of it at a fairly controlled rate. It may comprise a series of small perforations punched into it, or can be constructed of any semi-permeable membrane material appropriate to its coolant-delivery function as will outlined herein. This semi-permeability characteristic is illustrated by the series of small dots 105 scattered throughout cooling envelope 104 as depicted in FIG. 1. Alternatively or in addition to permeations 105, cooling envelope 104 may comprise a one-way fluid or gas release valve 130 to relieve the build up within cooling envelope 104 of fluid or gas pressure. Release valve 130 can also comprise or be attached to an optional recirculation conduit (not shown) enabling spent coolant to be removed from cooling envelope 104 and reused or recycled.

At an open end (coolant entry opening), cooling envelope 104 is attached to a coolant delivery pipe 106 via an envelope connector 107. As depicted here, envelope connector 107 is a cone-shaped apparatus permanently affixed to coolant delivery pipe 106, and it further comprises a standard threading 108. Cooling envelope 104 itself, at this open end, is fitted and permanently affixed to complementary threading (shown, but unnumbered, in FIG. 2) that is easily screwed into and fitted with threading 108 of connector 107. While FIG. 1 depicts screw threads in connection with a cone-shaped apparatus as the particular means of attaching cooling envelope 104 to coolant delivery pipe 106, any type of clamp, and indeed, many other means of attachment know to someone of ordinary skill would also be provide a feasible and obvious alternative, and such substitutions for attaching cooling envelope 104 to coolant delivery pipe 106 are fully contemplated to be within the scope of this disclosure and its associated claims.

Coolant delivery pipe 106, in the region where said pipe resides within cooling envelope 104, further comprises a number of coolant delivery apertures 109, twin ring holders 110, and an optional butt plate 111. Explosive device 101 with detonator cap 102 is affixed to one end of an explosive connector (broomstick) 112 with explosive-to-broomstick attachment means 113 such as, but not limited to, duct tape, wire, rope, or any other means that provides a secure attachment. The other end of broomstick is slid through twin ring holders 110 until it abuts butt plate 111, as shown. At that point, broomstick 112, optionally, may be further secured by means of, for example, a bolt 114 and wingnut 115 running through both broomstick 112 and coolant delivery pipe 106 as depicted. While rings 110, butt plate 111, and nut and bolt 115 and 114 provide one way to secure broomstick 112 to coolant delivery pipe 106, many other ways to secure broomstick 112 to coolant delivery pipe 106 can also be devised by someone of ordinary skill, all of which are contemplated within the scope of this disclosure and its related claims. The length of broomstick 112 may vary, though for optimum effectiveness, it should maintain explosive device 101 at approximately two or more feet from the end of coolant delivery pipe 106 that contains coolant delivery apertures 109, which, since it is desirable to reuse coolant delivery pipe 106 and its components, will minimize any possible damage to coolant delivery pipe 106 and said components when explosive device 101 is detonated, and will also reduce any shock waves sent back down the pipe to the operator of this invention.

With the configuration disclosed thus far, liquid coolant such as water under pressure or gaseous coolant such as compressed air entering the left side of coolant delivery pipe 106 as depicted in FIG. 1 will travel through coolant delivery pipe 106 and exit coolant delivery pipe 106 through coolant delivery apertures 109 in a manner illustrated by directional flow arrows 116. Upon exiting coolant delivery pipe 106 through apertures 109, the coolant then enters the inside of cooling envelope 104 and begins to fill up and expand cooling envelope 104. As the coolant fills cooling envelope 104, comes into contact with and cools explosive device 101. Because cooling envelope 104 is semi-permeable (105) and/or comprises fluid or gas release valve 130, liquid or gaseous coolant will also exit cooling envelope 104 as cooling envelope 104 becomes full as shown by directional arrows 116*a*, and so the entry under pressure of new liquid or gaseous coolant into coolant delivery pipe 106 combined with the exit of liquid or gaseous through semi-permeable (105) cooling envelope 104 and/or release valve 130, delivers a continuous and stable flow of coolant to explosive device 101.

The entire cooling and cleaning delivery assembly 11 disclosed thus far, is in turn connected to a coolant supply and explosive positioning system 12 as follows. When the coolant employed is, for example, a fluid in the form of standard water, a hose 121 with water service (for example, but not limited to, a standard ¾" Chicago firehose and water service) is attached to a coolant supply tube 122 (e.g. pipe) using any suitable hose attachment fitting 123. This water coolant runs under pressure through hose 121 as indicated by directional flow arrow 120. The end of coolant supply tube 122 opposite hose 121 contains attachment means 124 such as screw threading, which complements and joins with similar threading 117 on coolant delivery pipe 106. Of course, any means known to someone of ordinary skill for joining coolant supply tube 122 and coolant delivery pipe 106 in the manner suggested by arrow 125 in FIG. 1, such that coolant can run from hose 121 through coolant supply tube 122, into coolant delivery pipe 106, and finally into cooling envelope 104, is acceptable and contemplated by this disclosure and its associated claims. When the coolant employed is a gas such as air, the configuration is substantially the same as for a liquid coolant, however, the coolant supply is then a standard compressor, an air conditioning unit, or any other suitable means of providing a pressurized gas into coolant supply tube 122. The various pipes and tubes of a gas-based system may also vary somewhat from those of a fluid-based system to accommodate gas rather than liquid, but the essential aspects of establishing a series of suitable pipes and hoses to deliver coolant into cooling envelope 104 and to explosive device 101 remain fundamentally the same.

Finally, detonation is achieved by electronically connecting explosive detonator cap 102 to initiator 103. This is achieved by connecting initiator 103 to a lead wire pair 126, in turn connecting to a second lead wire pair 118, in turn connecting to a cap wire pair 119. Cap wire pair 119 is finally connected to detonator cap 102. Lead wire pair 126 enters coolant supply tube 122 from initiator 103 through a lead wire entry port 127 as shown, and then runs through the inside of coolant supply tube 122, and out the far end of coolant supply tube. (Entry port 127 can be constructed in any manner obvious to someone of ordinary skill, so long as it enables wire 126 to enter coolant supply tube 122 and averts any significant coolant leakage.) Second lead wire pair 118 runs through the inside of coolant delivery pipe 106, and cap wire pair 119 is enclosed within cooling envelope 104 as shown. Thus, when initiator 103 is activated by the operator, an electronic current flows straight to detonator cap 102, detonating explosive device 101.

While FIG. 1 thus depicts electronic detonation of detonator cap 102 and explosive device 101 via a hard wire signal connection, it is contemplated that any alternative means of detonation known to someone of ordinary skill could also be employed, and is encompassed by this disclosure and its associated claims. Thus, for example, detonation by a remote control signal connection between initiator 103 and detonator cap 102 (which will be further discussed in FIG. 4), eliminating the need for wires 126, 118, and 119, is very much an alternative preferred embodiment for detonation. Similarly, non-electronic shock (i.e. percussion) and heat-sensitive detonation can also be used within the spirit and scope of this disclosure and its associated claims.

While any suitable liquid or gas can be pumped into this system as a liquid or gaseous coolant, the preferred liquid coolant is ordinary water, and the preferred gaseous coolant is ordinary atmospheric air. This is less expensive than any other coolant, it performs the necessary cooling properly, and it is readily available at any site which has a pressurized water or air supply that may be delivered into this system.

Notwithstanding this preference for ordinary water or air as the coolant, this disclosure contemplates that many other coolants known to someone of ordinary skill can also be used for this purpose as well, and all such coolants are regarded to be within the scope of the claims.

Figure 2:
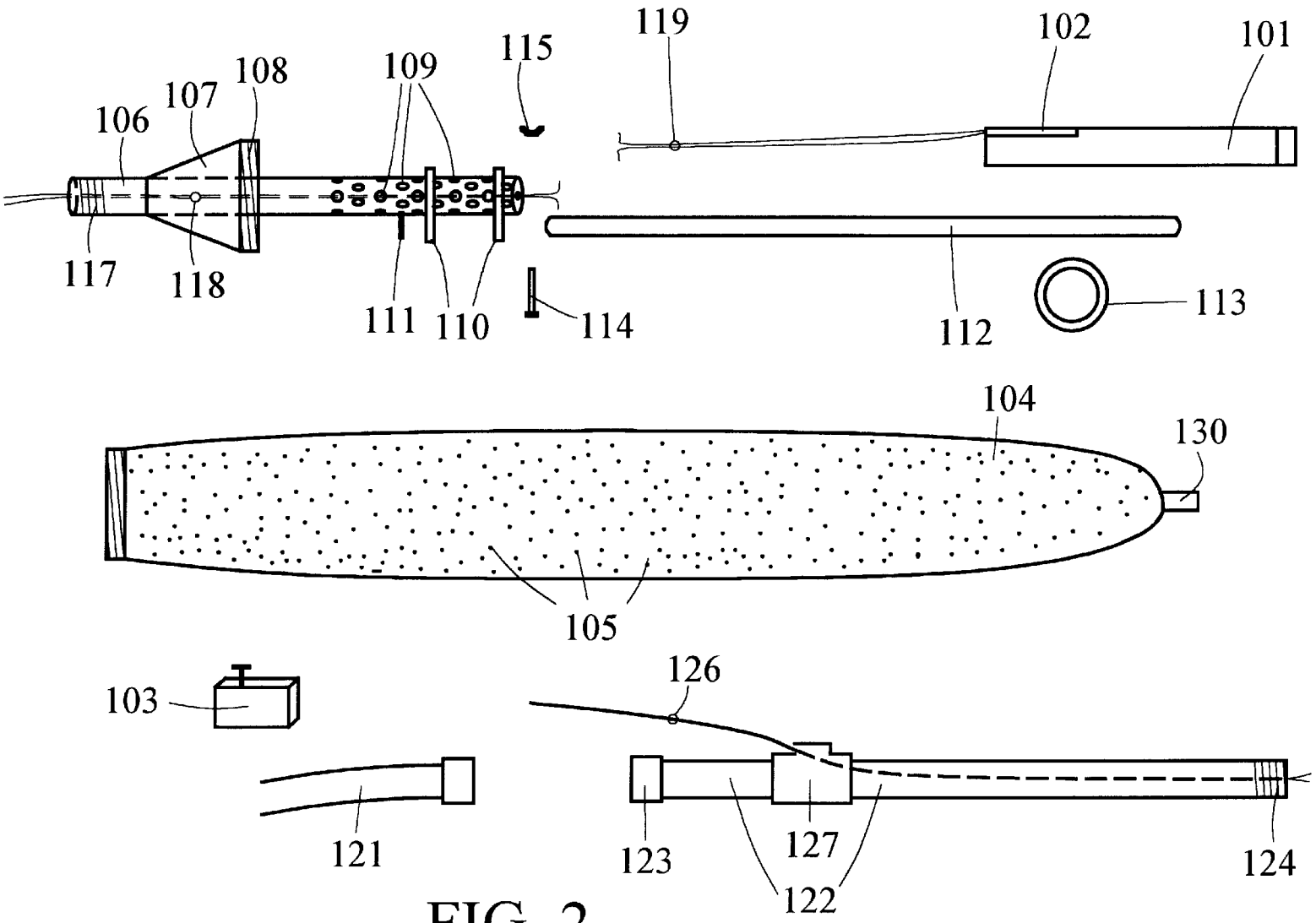
FIG. 2 illustrates in plan view, the device, system and method of FIG. 1 in its disassembled (preassembly) state, and is used to illustrate the method by which this device, system and method is assembled for use.

At this point, we turn to discuss methods by which the on-line cleaning device disclosed above is assembled for use and then used. FIG. 2 shows the preferred embodiment of FIG. 1 in preassembly state, disassembled into its primary components. Explosive device 101 is attached to detonator cap 102, with detonator cap 102 in turn connected to the one end of cap wire pair 119. This assembly is attached to one end of broomstick 112 using explosive-to-broomstick attachment means 113 such as duct tape, wire, rope, etc., or any other approach known to someone of ordinary skill, as earlier depicted in FIG. 1. The other end of broomstick 112 is slid into twin ring holders 110 of coolant delivery pipe 106 until it abuts butt plate 111, also as earlier shown in FIG. 1. Bolt 114 and nut 115, or any other obvious means, may be used to further secure broomstick 112 to coolant delivery pipe 106. Second lead wire pair 118 is attached to the remaining end of cap wire pair 119 to provide an electronic connection therebetween. Once this assemblage has been achieved, cooling envelope 104 comprising permeations 105 and/or release valve 130 is slid over the entire assembly, and attached to envelope connector 107 using threading 108, clamp, or any other obvious attachment means, as depicted in FIG. 1.

The right-hand side (in FIG. 2) of lead wire pair 126 is attached to the remaining end of second lead wire pair 118 providing an electronic connection therebetween. Coolant delivery pipe 106 is then attached to one end of coolant supply tube 122 as also discussed in connection with FIG. 1, and hose 121 is hooked to the other end of coolant supply tube 122, completing all coolant delivery connections. Initiator 103 is attached to the remaining end of lead wire pair 126 forming an electronic connection therebetween, and completing the electronic connection from initiator 103 to detonator cap 102.

When all of the above connections have been achieved, the on-line cleaning device is fully assembled into the configuration shown in FIG. 1.

Figure 3:
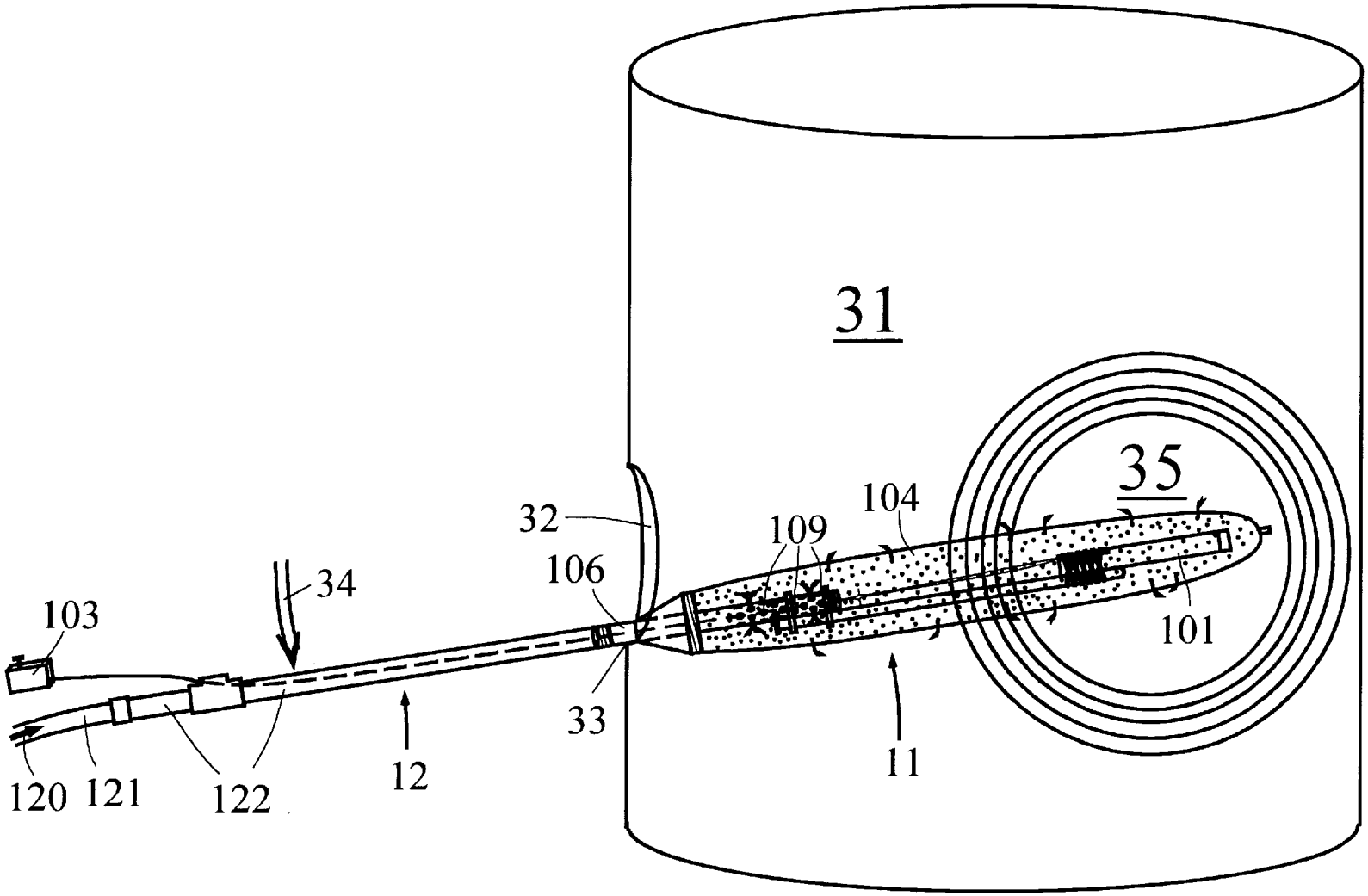
FIG. 3 illustrates in plan view, the use of the subject device, system and method to clean an on-line fuel burning or incineration facility.

FIG. 3 now depicts the usage of this fully assembled on-line cleaning device, to clean a fuel burning facility 31 such as a boiler, furnace, scrubber, incinerator, etc., and indeed any fuel-burning or refuse-burning device for which cleaning by explosives is suitable. Once the cleaning device has been assembled as discussed in connection with FIG. 2, the flow 120 of liquid or gaseous coolant through hose 121 is commenced. As the coolant passes through coolant supply tube 122 and coolant delivery pipe 106, it emerges from coolant apertures 109 to fill cooling envelope 104 and provide a flow of coolant (e.g. water or air) to surround explosive device 101, maintaining explosive device 101 at a relatively cool temperature. By way of example, not limitation, optimal flow rates for water range between approximately 20 and 80 gallons per minute, and for air, between approximately 5 to 10 cubic feet per minute at 10 to 90 psi, depending on the ambient temperature to be protected against.

Once this liquid or gas flow is established and explosive device 101 is maintained in a cool state, the entire cooling and cleaning delivery assembly 11 is placed into on-line facility 31 through an entry port 32 such as a manway, handway, portal, or other similar means of entry, while coolant supply and explosive positioning system 12 remains outside of said facility. At a location near where assembly 11 meets system 12, coolant delivery pipe 106 or coolant supply tube 122 is rested against the bottom of entry port 32 proximate the point designated by 33. Because a liquid coolant pumped through cooling envelope 104 introduces a fair amount of weight into assembly 11 (with some weight also added to system 12), a downward force designated by 34 is exerted to system 12, with point 33 acting as the fulcrum. Applying appropriate force 34 and using 33 as the fulcrum, the operator moves and positions explosive device 101 freely through on-line facility 31 to the position desired. It is further possible to place a fulcrum fitting device (not shown) at location 33, so as to provide a stable fulcrum and also protect the bottom of port 32 from the significant weight pressure exerted at the fulcrum. Throughout this time, new (cooler) coolant is constantly flowing into the system while older (hotter) coolant which has been heated by the on-line facility exits via semipermeable cooling envelope 104 and/or release valve 130, so that a continuous flow of coolant into the system maintains explosive device 101 in a cool state. For gaseous coolant, the added weight introduced by a fluid coolant as discussed above is not an issue. Finally, when the operator has moved explosive device 101 in the desired position, initiator 103 is activated to initiate the explosion. This explosion creates a shock wave in region 35, which thereby cleans and deslags that region of the boiler or similar facility, while the boiler/facility is still hot and on-line.

As used herein, "envelope and explosive positioning means" shall be interpreted to refer to whatever means might be apparent to and employed by someone of ordinary skill to move cooling envelope 104 and the cooled explosive device 101 therein through on-line facility 31 and into position for at will detonation. As disclosed above, the "envelope and explosive positioning means" comprises drawing elements 12, 106, and 112, but it is to be clearly understood that many other configurations for this envelope and explosive positioning means may occur to and be used by someone of ordinary skill fully within the scope of this disclosure and its associated claims.

Referring back to FIG. 2, during the explosion, explosive device 101, detonator cap 102, cap wire 119, broomstick 112, and broomstick attachment means 113 are all destroyed by the explosion, as is cooling envelope 104. Thus, it is preferable to fabricate broomstick 112 out of wood or some other material that is extremely inexpensive and disposable after a single use. Similarly, cooling envelope 104, which is for a single use only, should be fabricated from a material that is inexpensive, yet durable enough to maintain physical integrity while fluid or gas is being pumped into it under pressure. And of course, cooling envelope 104 must enable a continuous flow of coolant, and so, for example, should be semi-permeable (105) or contain some other suitable means such as release valve 130 that enable a continuous supply of cool coolant to enter proximate explosive device 101 as hotter coolant exits. Semipermeability 105 can be achieved, for example, by using any appropriate membrane which in essence acts as a filter, either with a limited number of macroscopic puncture holes, or a large number of fine, microscopic holes. Release valve 130 may be any suitable air or fluid release valve known in the art, and again, may be used in addition to or in place of semipermeability 105.

On the other hand, all other components, particularly coolant delivery pipe 106 and all of its components 107, 108, 109, 110, 111, and 118, as well as bolt 114 and nut 115, are reusable, and so should be designed from materials that provide proper durability in the vicinity of the explosion. (Again, note that the length of broomstick 112 determines the distance of coolant delivery pipe 106 and its said components from the explosion, and that approximately two feet or more is a desirable distance to impose between explosive device 101 and any said component of coolant delivery pipe 106, to minimize explosive damage and shock waves back to the operator.)

Additionally, because liquid coolant filling cooling envelope 104 adds significant weight to the right of fulcrum 33 in FIG. 3, if the coolant to be used is a fluid, the materials used to construct cleaning delivery assembly 11 should be as lightweight as possible so long as they can endure both the heat of the furnace and the explosion (cooling envelope 104 should be as light as possible yet resistant to any possible heat damage), while to counterbalance the weight of 11, coolant supply and explosive positioning system 12 may be constructed of heavier materials, and may optionally include added weight simply for ballast. Water weight can also be counterbalanced by lengthening system 12 so that force 34 can be applied farther from fulcrum 33. And of course, although system 12 is shown here as embodying a single coolant supply tube 122, it is obvious that this assembly can also be designed to employ a plurality of tubes attached to one another, and can also be designed so as to telescope from a shorter tube into a longer tube. All such variations, and others that may be obvious to someone of ordinary skill, are fully contemplated by this disclosure and included within the scope of its associated claims.

Figure 4:
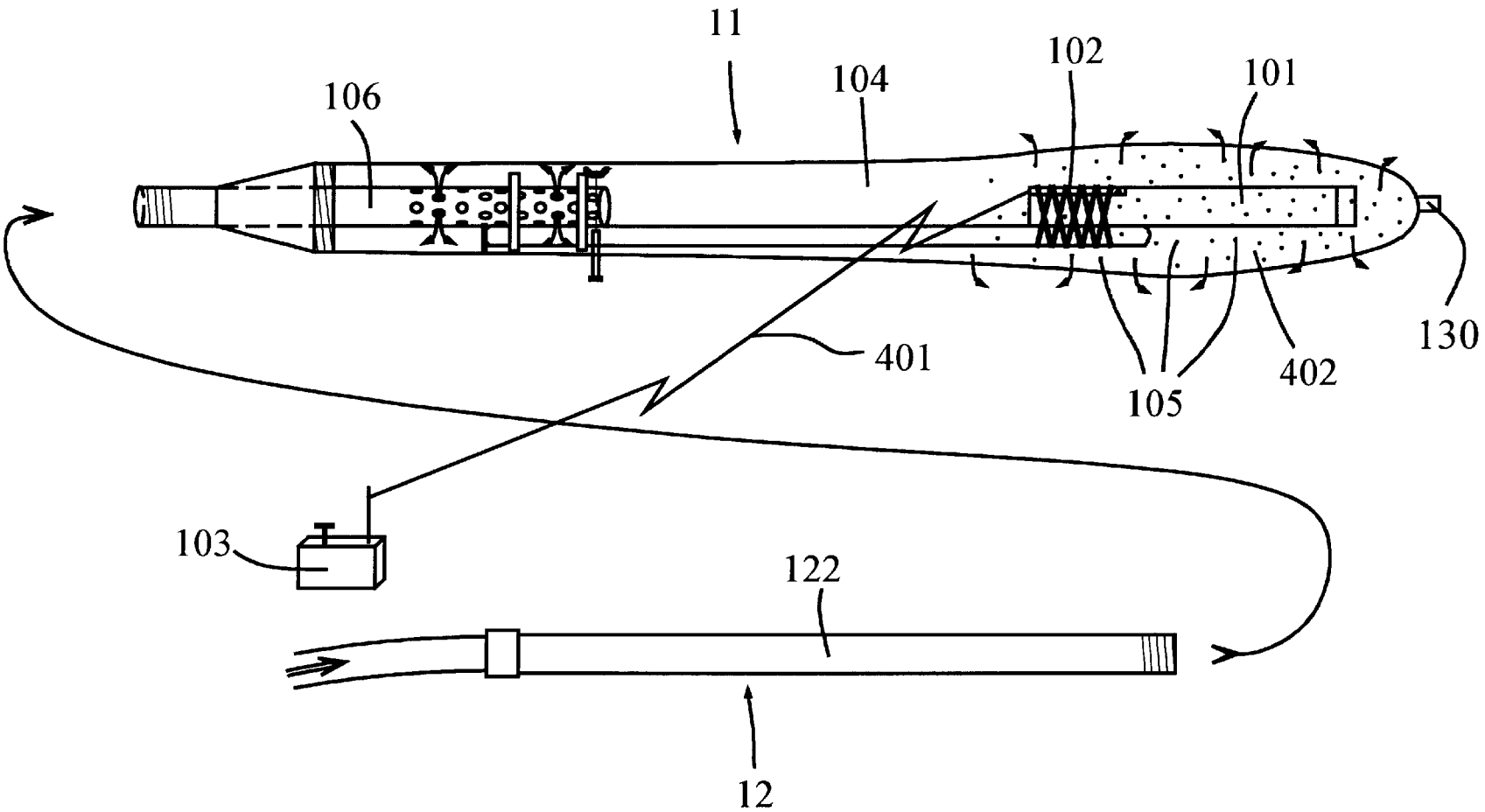
FIG. 4 illustrates in plan view, an alternative preferred embodiment of this invention, which reduces coolant weight and enhances control over coolant flow, and which utilizes remote detonation.

FIG. 4 depicts an alternative preferred embodiment of this invention with reduced coolant weight and enhanced control over coolant flow, and remote detonation.

In this alternative embodiment, detonator cap 102 now detonates explosive device 101 by a remote control, wireless signal connection 401 sent from initiator 103 to detonator cap 102. This eliminates the need for lead wire entry port 127 that was shown in FIG. 1 on coolant supply tube 122, as well as the need to run wire pairs 126, 118 and 119 through the system to carry current from initiator 103 to detonator cap 102.

FIG. 4 further shows a modified embodiment of cooling envelope 104, which is narrower where coolant first enters from coolant delivery pipe 106 and wider in region 402 of explosive device 101. Additionally, this cooling envelope is impermeable in the region where coolant first enters coolant delivery pipe 106, and permeable (105) only in the region near explosive device 101. This modification achieves two results.

First, since a main object of this invention is to cool explosive device 101 so that it can be introduced into an on-line fuel-burning facility, it is desirable to make the region of cooling envelope 104 where explosive device 101 is not present as narrow as possible, thus reducing the water weight in this region and making it easier to achieve a proper weight balance about fulcrum 33, as discussed in connection with FIG. 3. Similarly, by broadening cooling envelope 104 near explosive device 101, as shown by 402, a greater volume of coolant will reside in precisely the area that it is needed to cool explosive device 101, thus enhancing cooling efficiency. This modification is particularly pertinent to fluid cooling, where fluid weight is an issue.

Second, since it desirable for hotter coolant that has been in the modified cooling envelope 104 of FIG. 4 for a period of time to leave the system in favor of cooler coolant being newly introduced into this envelope, the impermeability of the entry region and midsection of cooling envelope 104 enables all newly-introduced coolant to reach explosive device 101 before that coolant is allowed to exit cooling envelope 104 from its permeable (105) section 402. Similarly, coolant in the permeable region of cooling envelope 104 will typically have been in the envelope longest, and will therefore be the hottest. Hence, the hotter coolant leaving the system is precisely the coolant that should be leaving, while the cooler coolant cannot exit the system until it has traveled through the entire system and thus become hotter and therefore ready to leave. This essential result is also achieved when release valve 130 is placed proximate the end of cooling envelope 104 that envelopes explosive device 101, as illustrated, since coolant will have traveled all the way through the system by the time it exits. It is to be noted that the modified embodiment of FIG. 4 is pertinent to both liquid and gas cooling.

Because the essential objective of the invention disclosed herein is to permit explosive device 101 to be moved through and freely positioned within a hot, online heat exchange device 31 without premature detonation, and then detonated at will, alternative preferred embodiments are also feasible which dispense with or supplement the liquid or gaseous coolants described above, in favor of using heat-resistant materials to cool the explosive and thereby protect the explosive from premature detonation.

Figure 5:
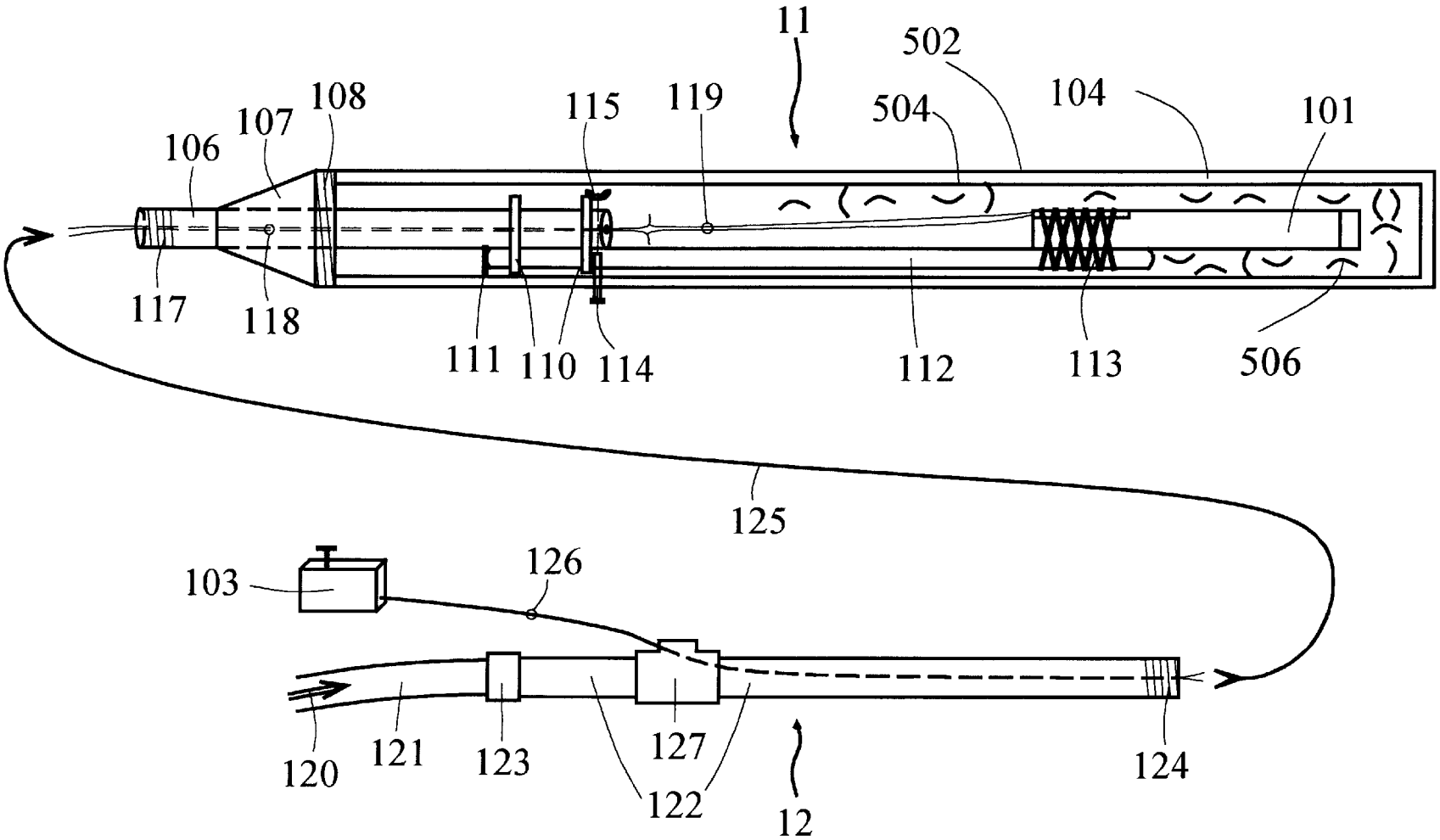
FIG. 5 illustrates in plan view, the use of highly-heat-resistant insulating materials to insulate explosive device used for on-line explosive cleaning, in place of or in addition to the aforementioned liquid or gaseous coolants.

Along these lines, FIG. 5 illustrates an alternative embodiment using one or more highly-heat-resistant insulating materials to insulate explosive device 101 and detonator cap 102, in place of or in addition to the aforementioned liquid or gaseous coolants, thereby maintain explosive device 101 such that it remains cooled and does not detonate prematurely. In this embodiment, most aspects of FIGS. 1 through 4 remain fully intact. However, in this embodiment, cooling envelope 104 surrounding explosive device 101 and detonator cap 102 comprises a flame retardant, high heat-resistant material. This embodiment of cooling envelope 104 maintains a sufficiently cool ambient temperature inside envelope 104 to protect against the heat of online heat-exchange device 31, thereby preventing premature discharge or degradation of explosive device 101. As with the earlier-described embodiments, cooling envelope 104 fits over explosive device 101 and detonator cap 102, and be sealed at the cooling envelope opening proximate 108. This can be achieved simply by using the threaded connection at 108 as earlier described, or alternatively, but not limiting, using high heat-resistant tape or other methods of fastening, including wire or high heat-resistant rope.

In its preferred embodiment, heat-resistant cooling envelope 104 of FIG. 5 comprises both an outer insulating layer 502 and an optional but preferred inner insulating layer 504 to maximize heat-resistant protection. Outer insulating layer 502 comprises at least one layer of, for example, commercially-available knitted silica, fiberglass and/or ceramic cloth, including, but not limited to: knitted (or unknitted) silica cloth, aluminized silica cloth, silicone coated silica cloth, fiberglass cloth, silicone impregnated fiberglass fabric, vermiculite coated fiberglass, neoprene coated fiberglass, ceramic knitted (or unknitted) cloth and/or silica glass yarns knitted into a cloth. The silica, fiberglass and/or ceramic fabrics or cloths may be treated or untreated. Such cloths or fabrics may be treated with vermiculite or neoprene or any other flame retardant and heat-resistant chemical or material to increase the insulating factor of the cloth. In addition, there are cloths in the marketplace made of silica, fiberglass and/or ceramic which are treated with processes for which the treatments are proprietary and/or have not been publicly disclosed. Combinations using more than one of the aforementioned insulators are also suitable, and are considered within the scope of this disclosure and its associated claims.

Optional but preferred inner insulating layer 504 comprises a suitably-reflective material, for example, aluminum foil (aluminized) cloth. Inner insulating layer 504 is oriented to reflects outward, away from explosive device 101 and detonator cap 102, any heat that penetrates outer insulating layer 502. Inner insulating layer 504 can be independent of, but within, inner insulating layer 502, or it can be attached directly to the inner side of outer insulating layer 502. Other suitable materials for inner insulating layer 504 include, but are not limited to, silica cloth, fiberglass cloth, ceramic cloth, and/or stainless steel cloth. Various combinations of more than one of the above cloths are possible as well. For example, not limitation, fiberglass or silica cloths can be aluminized, thus resulting in an aluminized fiberglass cloth or an aluminized silica cloth. And any or all of the cloths mentioned above, separately or in combination, can be treated in various proprietary and non-proprietary ways known in the art.

Cooling envelope 104 in this embodiment is preferably cylindrical, fitting over explosive device 101 and detonator cap 102, just as in the earlier embodiments. The open end of cooling envelope 104 may be preattached to screw threads as illustrated in FIG. 2, or may be pre-sewn closed or closed by using any heat-resistant material such as high heat-resistant tape, wire or heat-resistant rope. Once this embodiment of cooling envelope 104 is slipped over explosive device 101 and detonator cap 102, the open end of the tube is closed by the methods described above.

Detonator cap 102 continues to be detonated as described above, using any of electronic, non-electronic (e.g., shock/percussion and heat-sensitive detonation), or remote control means. For electronic detonation, another consideration in this embodiment is the insulation of the wire 118, 119, 126 which is connected to detonator cap 102. This wire 118, 119, 126 is run inside coolant delivery pipe 106 as in the earlier embodiments, or may be run outside of this pipe. Coolant delivery pipe 106 in the present embodiment in fact does not need to deliver any coolant (unless this embodiment is combined with the earlier, coolant-utilizing embodiments of FIGS. 1 through 4), and so need not comprise coolant apertures 109. But in any event, it is preferred to use an insulated high heat-resistant wire. Such wire products are commercially available. If additional insulation of the wire is needed, the wire may be further insulated using high heat-resistant tape, and/or one of the heat-resistant materials mentioned above for outer insulating layer 502 may be wrapped around such wire.

If additional insulation is needed against extremely high heat environments, this embodiment of cooling envelope 104 may also be filled with optional non-flammable bulk fiber insulation 506. The preferred material for bulk fiber insulation 506 is an amorphous silica fiber, however, other suitable materials which may be used for this purpose include any of the materials mentioned earlier as suitable for outer insulating layer 502; however, for use as insulation 506, these materials are preferably not woven into a cloth, but are used in a bulk, fibrous form.

This embodiment achieves an insulating factor of more than two-thousand degrees Fahrenheit (2000° F.), and the insulation materials themselves have a melting temperature in excess of three-thousand degrees Fahrenheit (3000° F.).

This embodiment may be used in a wide variety of heated environments. The temperature at which explosive device 101 detonates will dictate the number of insulating layers, types, and thickness of the insulting materials that are used. These factors determine the amount of insulation need to protect explosive device 101 and detonator cap 102 in the environment in which they are placed. Because cooling envelope 104 is destroyed with each explosion, it is desirable to use only those insulating layers and materials which are essential for any given heat environment, so as to minimize the cost of materials used or this single-use cooling envelope 104.

It is important to emphasize that while the embodiment of FIG. 5 can stand alone, it may also be used in combination with the embodiment of FIGS. 1 through 4. That is, the embodiment of FIG. 5 may be combined with fluid or air coolants, as described above, by providing cooling envelope 104 with permeations 105 and/or release valve 130 as earlier shown and described, or it can stand alone without coolants.

In the event that the embodiment of FIG. 5 used standing alone, all that needs to change from the embodiments of FIGS. 1 through 4 is that liquid or gas coolant need not be supplied, and that cooling envelope 104 must be insulted as described above. The various pipes and conduits 122, 106 need not be—but still may be—hollowed so as to carry liquid or gas, and coolant delivery pipe 106 need not—but still may—comprise coolant apertures 109. Fluid weight is not an issue when FIG. 5 is used as a stand-alone embodiment, since no fluid is involved. The assembled apparatus is introduced into, moved freely through, and used in connection with online heat exchange device 31, precisely as earlier described in connection with FIG. 3.

Figure 6:
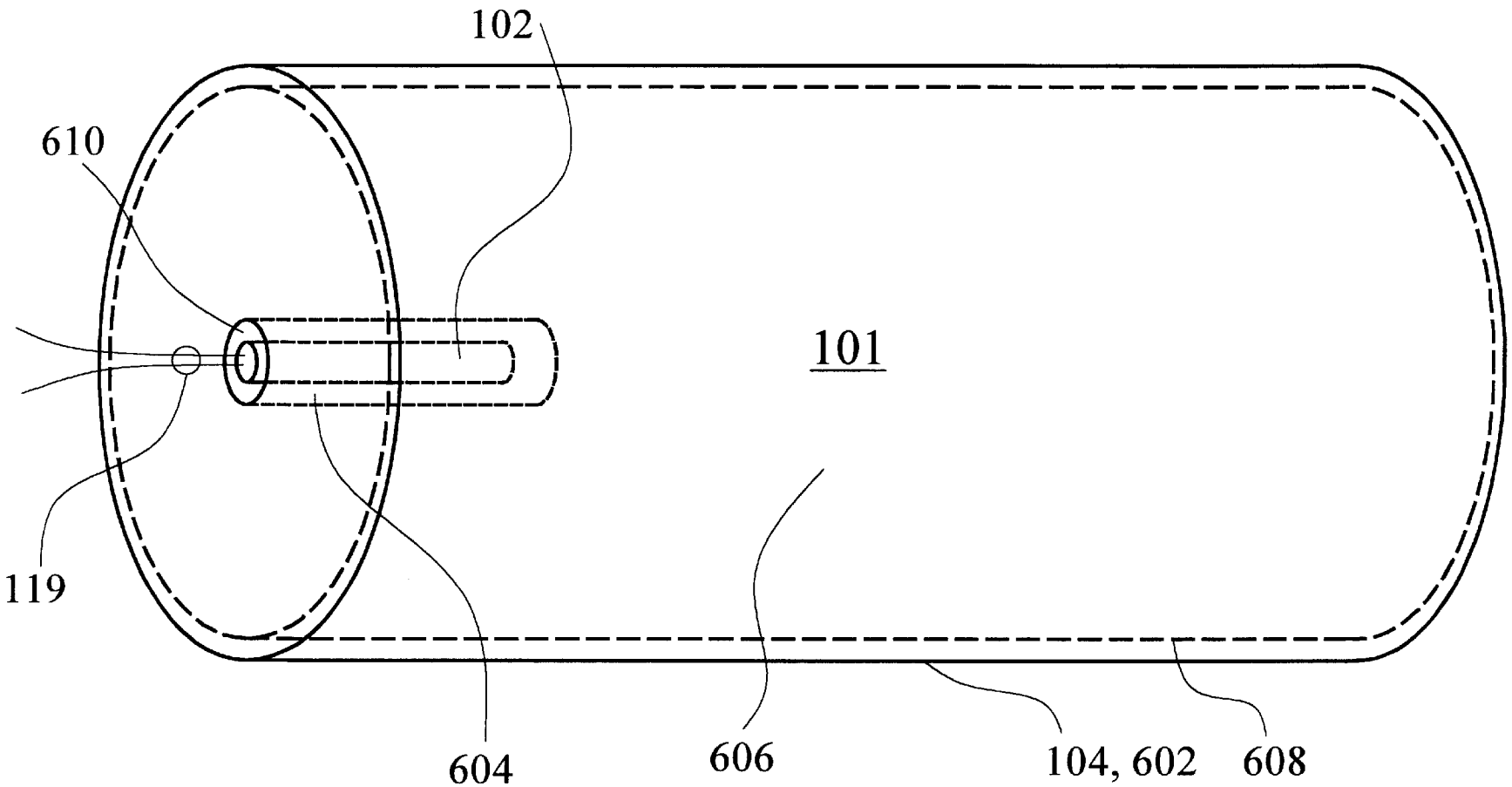
FIG. 6 illustrates in perspective view, a heat-resistant explosive preparation used for on-line explosive cleaning, in place of or in addition to the embodiments of FIGS. 1 through 5.

FIG. 6 illustrates an alternative preferred embodiment wherein explosive device 101 is itself prepared to be highly heat-resistive, so it can be used for deslagging in place of or in addition to the aforementioned liquid or gaseous coolants, and/or the aforementioned highly-heat-resistant insulating cooling envelope 104, in any desired combination.

In this embodiment, neither the liquid nor gaseous coolant of FIGS. 1 through 4, nor the insulated cooling envelope 104 of FIG. 5, is required. Rather, explosive device 101, detonator cap 102, and cap wire pair 119 (if any wire is used) are constructed to be self-insulating and thereby self-cooling. The preferred explosive material 606 used inside of explosive device 101 is a pliable explosive emoltion, but other suitable materials may also be used within the scope of this disclosure and its associated claims. This emoltion is injected into and encased within a heat-resistant explosive casing 602 made from or insulted by at least one layer of one or more of the various heat-resistant fabrics and cloths described above in connection with FIG. 5 (e.g. silica cloth, aluminized silica cloth, silicone coated silica cloth, fiberglass cloth, silicone impregnated fiberglass cloth, vermiculite coated fiberglass, neoprene coated fiberglass, ceramic cloth and/or silica glass yarns knitted into a cloth, including the various treatments mentioned above). In a preferred variation of this embodiment, such heat-resistant material replaces the traditional outside plastic or paper product explosive casing which holds explosive material 606. In an alternative variation, this explosive casing 602 is wrapped around, and simply insulates, a non-heat-resistant traditional plastic or paper product explosive casing 608. Traditional explosive casing 608 is shown in dashed lines since it is omitted entirely in the preferred variation of this embodiment.

Explosive device 101 explosive casing 602 also comprises a detonator well 604 sufficiently removed from the outside surface of explosive device 101 and explosive casing 602 such that detonator cap 102, when placed into said detonator well 604, will be suitably insulted. Preferably, detonator well 604 is located substantially proximate the center of explosive casing 602, as illustrated. This allows detonator cap 102 to be inserted in the center of the explosive charge and thereby maximally insulated. As in the previous embodiments, detonator cap 102 is detonated by electronic, non-electronic or remote control means.

Once detonator cap 102 is inserted into detonator well 604 of explosive device 101, the end may be sealed using high heat-resistant tape at 610. Any exposed wires such as 119 may be insulated or re-insulated using high heat-resistant tape. Another method of insulating wires such as 119 is to cover these wires using insulating fabric tubing such as silica or fiberglass tubing, or silicone coated fiberglass or silicone tubing. Indeed, the insulting fabrics discussed in connection with outer insulating layer 502 of FIG. 5 may all be applied with equal facility to insulating any and all detonating wires.

For additional heat tolerance, the explosive device 101 and detonator cap 102 of this embodiment may be cooled or even frozen before insertion into online heat-exchange device 31. Various methods of retaining the cold temperature following this cooling may be used at a job site including packing explosive device 101 and detonator cap 102 in dry ice or keeping such them in a refrigerator or freezer equipment.

This embodiment may also be used standing alone, or in combination with any of the other embodiments of FIGS. 1 through 5. That is, the high heat-resistant explosive device 101 of FIG. 6 may be further insulated by using the heat-resistant jacket as described in FIG. 5, and/or may be further protected using one of the cooling methods described in connection with FIGS. 1 through 4. It is also to be noted that the explosive device 101 of FIG. 6 can be used in any environment where it is desirable to have a controlled detonation of explosives within a hot surrounding environment.

Because it is possible to utilize the embodiments disclosed herein separately or in combination with one another, any cooling envelope 104 that supplies a liquid or gas coolant will be referred to herein as a "coolant-supplying" envelope, any cooling envelope 104 that is insulated 502, 504, 506 will be referred to herein as an "insulating" envelope, and any cooling envelope 104 that comprises explosive casing 602 will be referred to herein as a "casing" envelope. Thus, for example, not limitation, if a number of the embodiments disclosed herein were to be used in combination, one might for example, simultaneously employ three cooling envelopes 104 such that a casing envelope 104, 602 encases explosive material 606 and comprises explosive device 101, such that an insulating envelope 104, 502, 504, 506 surrounds and further insulates casing envelope 104, 602, and such that a coolant-supplying envelope 104, with semipermeability 105 and/or valve 130 in turn surrounds and delivers liquid and/or gaseous coolant to insulating envelope 104, 502, 504, 506.

While many variations will occur to someone of ordinary skill based on general knowledge of the field as well as the prior disclosures herein, when this embodiment is used standing alone, all that is really necessary is to attach the explosive device 101 of FIG. 6 to a longer embodiment of a "broomstick" such as 112, using any suitable explosive-to-broomstick attachment means 113 such as, but not limited to, duct tape, wire, rope, or any other means that provides a secure attachment. (See the discussion of this attachment in connection with FIG. 2.) An elongated broomstick 112, or any other pole configuration that might occur to someone of ordinary skill, is then used to move explosive device 101 into, and freely through, online heat exchange device 31. Explosive device 101 is then detonated at will, again, as earlier described in connection with FIG. 3.

While the disclosure thus far has discussed several preferred embodiments, it will be obvious to someone of ordinary skill that there are many alternative embodiments for achieving the result of the disclosed invention. For example, although an envelope/stick configuration and a single explosive device was discussed here, any other geometric configuration of explosives, including a plurality of explosive devices, and/or including the introduction of various delay timing features as among such a plurality of explosive devices, is also contemplated within the scope of this disclosure and its associated claims. This would include, for example, the various explosive configurations such as those disclosed in the various U.S. Patents earlier-cited herein, wherein these explosive configurations are provided a similar means by which a coolant can be delivered to the explosive, or the explosive can be suitably heat insulted, in such a way as to permit on-line detonation. In short, it is contemplated that the delivery of coolant to one or more explosive devices by any means obvious to someone of ordinary skill, enabling those explosive devices to be introduced into an on-line fuel-burning facility and then simultaneously or serially detonated in a controlled manner, is contemplated by this disclosure and covered within the scope of its associated claims.

It is to be understood that the terms "cool" and "cooling" are to be broadly interpreted, recognizing that the key object of this invention is to maintain the explosive in a sufficiently cool state prior to the desired time of detonation so that it does not prematurely detonate, and to allow this cooled explosive to be moved through online heat exchange device 31 to any desired detonation position prior to detonation at will. Thus, "cool" and "cooling" as interpreted herein, in the various embodiments, is achieved through several alternate approaches, namely: using liquid coolant, using gaseous coolant, using suitable insulation to surround the explosive device, and/or fabricating the explosive device itself so as to be self-insulating and self-cooling. In the embodiments utilizing insulation, the insulation is in fact maintaining the explosive in a cooler state than it would otherwise be in absent the insulation, and is thus serving to "cool," or is "cooling," the explosive within the scope of this disclosure and its associated claims, and within the fair meaning of the words "cool" and "cooling" as commonly understood, even through it may not be actively providing a cooling medium as do the coolant embodiments of this invention. In short, "cool" and "cooling" are to be understood as encompassing both active cooling, and insulating to preventing the overheating, of explosive device 101.

Further, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

We claim:

1. An explosives-based system for deslagging a hot online heat-exchange device, comprising:

an explosive device;

at least one cooling apparatus cooling said explosive device particularly while said explosive device is at any desired location within said hot online heat exchange device, thereby preventing heat from said hot online heat exchange device from detonating said explosive device prior to a time when it is desired to detonate at will said explosive device;

a cooling apparatus and explosive positioning system with said at least one cooling apparatus and said explosive device cooled thereby affixed thereto, enabling a force applied to said cooling apparatus and explosive positioning system to freely move said at least one cooling apparatus and said explosive device cooled thereby to said any desired location within said hot online heat exchange device and particularly into a proper position for deslagging, while cooling said explosive device; and detonating means for detonating at will said explosive device.

2. The system of claim 1, said at least one cooling apparatus comprising:

a coolant-delivery apparatus delivering a coolant to said explosive device, said coolant so-cooling said explosive device.

3. The system of claim 2, said coolant comprising a liquid.

4. The system of claim 3, the liquid coolant comprising water.

5. The system of claim 2, said coolant comprising a gas.

6. The system of claim 5, the gaseous coolant comprising air.

7. The system of claim 2, said coolant-delivery apparatus comprising a semipermeable cooling envelope, thereby enabling said coolant to flow continuously into, through, and out of said cooling envelope and so-cool said explosive device.

8. The system of claim 2, said coolant-delivery apparatus comprising a cooling envelope further comprising a release valve, thereby enabling said coolant to flow continuously into, through, and out of said cooling envelope and so-cool said explosive device.

9. The system of claim 2, said at least one cooling apparatus further comprising at least one cooling envelope further comprising an insulating one of said cooling envelopes, said insulating one of said cooling envelopes comprising:

an outer insulating layer comprising at least one layer of at least one heat insulating material insulating said explosive device from said heat from said hot online heat exchange device, and thereby preventing from overheating, and so-cooling, said explosive device.

10. The system of claim 9, said insulating one of said cooling envelopes further comprising:

an inner insulating layer comprising at least one heat-reflective material further insulating said explosive device from said heat from said hot online heat exchange device, and thereby further preventing from overheating, and so-cooling, said explosive device, by reflecting any heat penetrating said outer insulating layer away from said explosive device.

11. The system of claim 10, further comprising:

non-flammable bulk fiber insulation within said insulating one of said cooling envelopes further insulating said explosive device from said heat from said hot online heat exchange device, and thereby further preventing from overheating, and so-cooling, said explosive device.

12. The system of claim 11, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

13. The system of claim 10, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

14. The system of claim 9, further comprising:

non-flammable bulk fiber insulation within said insulating one of said cooling envelopes further insulating said explosive device from said heat from said hot online heat exchange device, and thereby further preventing from overheating, and so-cooling, said explosive device.

15. The system of claim 14, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

16. The system of claim 9, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

17. The system of claim 2, wherein said explosive device is substantially fixed relative to said cooling apparatus.

18. The system of claim 2, wherein said any desired location within said hot online heat exchange device comprises a furnace region of said hot online heat exchange device.

19. The system of claim 1, said at least one cooling apparatus comprising at least one cooling envelope in turn comprising an insulating one of said cooling envelopes comprising:

an outer insulating layer comprising at least one layer of at least one heat insulating material insulating said explosive device from said heat from said hot online heat exchange device, and thereby preventing from overheating, and so-cooling, said explosive device.

20. The system of claim 19, said insulating one of said cooling envelopes further comprising:

an inner insulating layer comprising at least one heat-reflective material further insulating said explosive device from said heat from said hot online heat exchange device, and thereby further preventing from overheating, and so-cooling, said explosive device, by reflecting any heat penetrating said outer insulating layer away from said explosive device.

21. The system of claim 20, further comprising:

non-flammable bulk fiber insulation within said insulating one of said cooling envelopes further insulating said explosive device from said heat from said hot online heat exchange device, and thereby further preventing from overheating, and so-cooling, said explosive device.

22. The system of claim 21, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

23. The system of claim 20, said at least one heat-reflective material selected from the heat-reflective material group consisting of:

treated and untreated: aluminized cloth; silica cloth; fiberglass cloth; ceramic cloth; and stainless steel cloth.

24. The system of claim 20, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

25. The system of claim 19, further comprising:

non-flammable bulk fiber insulation within said insulating one of said cooling envelopes, further insulating said explosive device from said heat from said hot online heat exchange device, and thereby further preventing from overheating, and so-cooling, said explosive device.

26. The system of claim 25, said non-flammable bulk fiber insulation comprising at least one heat insulating material selected from the heat insulator group consisting of:

treated and untreated: amorphous silica fiber; silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

27. The system of claim 25, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

28. The system of claim 19, said at least one layer of said at least one heat insulating material selected from the heat insulator group consisting of:

treated and untreated: silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

29. The system of claim 19, said at least one cooling envelope comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

30. The system of claim 1, said at least one cooling apparatus comprising at least one cooling envelope in turn comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

31. The system of claim 30, further comprising a non-heat-resistant explosive casing encasing said explosive material, wherein said non-heat-resistant explosive casing and said explosive material therein is encased within said heat-resistant explosive casing.

32. The system of claim 30, said heat-resistant explosive casing comprising at least one layer of at least one heat insulating material selected from the heat insulator group consisting of:

treated and untreated: silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

33. The system of claim 2, said at least one cooling apparatus further comprising at least one cooling envelope in turn comprising a casing one of said cooling envelopes, said explosive device further comprising:

a heat-resistant explosive casing comprising said casing one of said cooling envelopes, and further comprising a detonator well sufficiently removed from an outside surface of said explosive device and said explosive casing to provide suitable heat insulation to a detonator cap placed within said detonator well; and explosive material encased within, and thereby insulated and prevented from overheating by said heat-resistant explosive casing.

34. The system of claim 1, wherein said explosive device is substantially fixed relative to said cooling apparatus.

35. The system of claim 1, wherein said any desired location within said hot online heat exchange device comprises a furnace region of said hot online heat exchange device.

36. A method for deslagging a hot, online heat-exchange device, comprising the steps of:

cooling an explosive device particularly while said explosive device is at any desired location within said hot online heat exchange device, thereby preventing heat from said hot online heat exchange device from detonating said explosive device prior to a time when it is desired to detonate at will said explosive device;

affixing said at least one cooling apparatus and said explosive device cooled thereby to a cooling apparatus and explosive positioning system;

applying a force to said cooling apparatus and explosive positioning system and thereby freely moving said at least one cooling apparatus and said explosive device cooled thereby to said any desired location within said hot online heat exchange device and particularly into a proper position for deslagging, while cooling said explosive device; and detonating at will said explosive device.

37. The method of claim 36, further comprising the step of:

delivering a coolant to said explosive device, said coolant so-cooling said explosive device, using a coolant-delivery apparatus.

38. The method of claim 37, said coolant comprising a liquid.

39. The method of claim 38, the liquid coolant comprising water.

40. The method of claim 37, said coolant comprising a gas.

41. The method of claim 40, the gaseous coolant comprising air.

42. The method of claim 37, said coolant-delivery apparatus comprising a semipermeable cooling envelope, further comprising the step of:

flowing said coolant continuously into, through, and out of said cooling envelope and so-cooling said explosive device.

43. The method of claim 37, said coolant-delivery apparatus comprising a cooling envelope, further comprising the step of:

flowing said coolant continuously into, through, and out of said cooling envelope and so-cooling said explosive device, using a release valve of said cooling envelope.

44. The method of claim 37, said at least one cooling apparatus further comprising at least one cooling envelope in turn comprising an insulating one of said cooling envelopes, further comprising the step of:

insulating said explosive device from said heat from said hot online heat exchange device, and thereby preventing from overheating, and so-cooling, said explosive device, using an outer insulating layer of said insulating one of said cooling envelopes comprising at least one layer of at least one heat insulating material.

45. The method of claim 44, further comprising the step of:

further insulating said explosive device from said heat from said hot online heat exchange device, and thereby further preventing from overheating, and so-cooling, said explosive device, by reflecting any heat penetrating said outer insulating layer away from said explosive device, using an inner insulating layer of said insulating one of said cooling envelopes comprising at least one heat-reflective material.

46. The method of claim 45, further comprising the step of:

further insulating said explosive device from said heat from said hot online heat exchange device, and thereby further preventing from overheating, and so-cooling, said explosive device, using non-flammable bulk fiber insulation within said insulating one of said cooling envelopes.

47. The method of claim 46, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

48. The method of claim 45, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

49. The method of claim 44, further comprising the step of:

further insulating said explosive device from said heat from said hot online heat exchange device, and thereby further preventing from overheating, and so-cooling, said explosive device, using non-flammable bulk fiber insulation within said insulating one of said cooling envelopes.

50. The method of claim 49, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

51. The method of claim 44, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

52. The method of claim 37, said at least one cooling apparatus further comprising at least one cooling envelope in turn comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

53. The method of claim 37, wherein said explosive device is substantially fixed relative to said cooling apparatus.

54. The method of claim 37, wherein said any desired location within said hot online heat exchange device comprises a furnace region of said hot online heat exchange device.

55. The method of claim 36, said at least one cooling apparatus comprising at least one cooling envelope in turn comprising an insulating one of said cooling envelopes, further comprising the step of:

insulating, said explosive device from said heat from said hot online heat exchange device, and thereby preventing from overheating, and so-cooling, said explosive device, using an outer insulating layer of said insulating one of said cooling envelopes comprising at least one layer of at least one heat insulating material.

56. The method of claim 55, further comprising the step of:

further insulating said explosive device from said heat from said hot online heat exchange device, and thereby further preventing from overheating, and so-cooling, said explosive device, by reflecting any heat penetrating said outer insulating layer away from said explosive device, using an inner insulating layer of said insulating one of said cooling envelopes comprising at least one heat-reflective material.

57. The method of claim 56, further comprising the step of:

further insulating said explosive device from said heat from said hot online heat exchange device, and thereby further preventing from overheating, and so-cooling, said explosive device, using non-flammable bulk fiber insulation within said insulating one of said cooling envelopes.

58. The method of claim 57, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

59. The method of claim 56, further comprising the step of selecting said at least one heat-reflective material from the heat-reflective material group consisting of:

treated and untreated: aluminized cloth; silica cloth; fiberglass cloth; ceramic cloth; and stainless steel cloth.

60. The method of claim 56, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

61. The method of claim 55, further comprising the step of:

further insulating said explosive device from said heat from said hot online heat exchange device, and thereby further preventing from overheating, and so-cooling, said explosive device, using non-flammable bulk fiber insulation within said insulating one of said cooling envelopes.

62. The method of claim 61, said non-flammable bulk fiber insulation comprising at least one heat insulating material, further comprising the step of selecting said at least one heat insulating material from the heat insulator group consisting of:

treated and untreated: amorphous silica fiber; silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

63. The method of claim 61, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

64. The method of claim 55, further comprising the step of selecting said at least one layer of said at least one heat insulating material from the heat insulator group consisting of:

treated and untreated: silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

65. The method of claim 55, said at least one cooling envelope comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

66. The method of claim 36, said at least one cooling apparatus comprising at least one cooling envelope in turn comprising a casing one of said cooling envelopes, comprising the further steps of providing said explosive device by:

encasing an explosive material within a heat-resistant explosive casing comprising said casing one of said cooling envelopes, and thereby insulating and preventing from overheating, said explosive material; and placing a detonator cap within a detonator well of said heat-resistant explosive casing, said detonator well sufficiently removed from an outside surface of said explosive device and said explosive casing, thereby suitably insulating and preventing from overheating, said detonator cap.

67. The method of claim 66, comprising the further steps of:

encasing said explosive material in a non-heat-resistant explosive casing; and encasing said non-heat-resistant explosive casing and said explosive material therein within said heat-resistant explosive casing.

68. The method of claim 66, comprising the further step of selecting at least one layer of at least one heat insulating material of said heat-resistant explosive casing from the heat insulator group consisting of:

treated and untreated: silica cloth; aluminized silica cloth; silicone coated silica cloth; fiberglass cloth; silicone impregnated fiberglass fabric; vermiculite coated fiberglass; neoprene coated fiberglass; ceramic cloth; and knitted silica glass.

69. The method of claim 36, wherein said explosive device is substantially fixed relative to said cooling apparatus.

70. The method of claim 36, wherein said any desired location within said hot online heat exchange device comprises a furnace region of said hot online heat exchange device.

* * * * *

UNITED STATES PATENT AND TRADEMARK OFFICE

CERTIFICATE OF CORRECTION

PATENT NO. : 6,321,690 B1
DATED : November 27, 2001
INVENTOR(S) : Zilka et al.

It is certified that error appears in the above-identified patent and that said Letters Patent is hereby corrected as shown below:

Title page,
Item [56], References Cited, under "OTHER PUBLICATIONS" please add the following:

-- VBB publication number 541 070 8 (GDR, 1930), pages 3440352 & 407

Jendersie, H. : Untersuchungen zum Konturensprengen beim untertagigen Abau. Neue Bergbautechnik 3 (1973) H. 3. --

Signed and Sealed this

Second Day of July, 2002

*Attest:*

*Attesting Officer*

JAMES E. ROGAN
*Director of the United States Patent and Trademark Office*